US006960760B2

(12) United States Patent
Bateman et al.

(10) Patent No.: US 6,960,760 B2
(45) Date of Patent: Nov. 1, 2005

(54) MASS SPECTROMETER

(75) Inventors: Robert Harold Bateman, Knutsford (GB); Kevin Giles, Altrincham (GB); Steve Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 67 days.

(21) Appl. No.: 10/829,451

(22) Filed: Apr. 22, 2004

(65) Prior Publication Data

US 2004/0195505 A1 Oct. 7, 2004

Related U.S. Application Data

(63) Continuation of application No. 10/178,854, filed on Jun. 25, 2002.

(30) Foreign Application Priority Data

| | | |
|---|---|---|
| Jun. 25, 2001 | (GB) | 0115409 |
| Aug. 9, 2001 | (GB) | 0119449 |
| Aug. 17, 2001 | (GB) | 0120111 |
| Aug. 17, 2001 | (GB) | 0120121 |

(51) Int. Cl.[7] ..... H01J 49/40; H01J 49/42; H01J 49/26

(52) U.S. Cl. ..... 250/286; 250/281; 250/282; 250/284; 250/287; 250/290

(58) Field of Search ..... 250/281, 282, 250/284, 286, 287, 288, 290

(56) References Cited

U.S. PATENT DOCUMENTS

| | | | |
|---|---|---|---|
| 3,621,242 | A | 11/1971 | Ferguson et al. |
| 4,072,862 | A | 2/1978 | Mamyrin et al. |
| 4,904,872 | A | 2/1990 | Grix et al. |
| 5,077,472 | A | 12/1991 | Davis |
| 5,206,506 | A | 4/1993 | Kirchner |
| 5,245,192 | A | 9/1993 | Houseman |
| 5,280,175 | A | 1/1994 | Karl |
| 5,572,035 | A | 11/1996 | Franzen |
| 5,654,543 | A | 8/1997 | Li |
| 5,661,300 | A | 8/1997 | Hansen |
| 5,811,800 | A | 9/1998 | Franzen et al. |
| 5,818,055 | A | 10/1998 | Franzen |
| 5,847,386 | A | 12/1998 | Thomson et al. |
| 5,880,466 | A | 3/1999 | Benner |
| 5,905,258 | A | 5/1999 | Clemmer et al. |
| 6,107,628 | A | 8/2000 | Smith et al. |
| 6,348,688 | B1 | 2/2002 | Vestal |
| 6,417,511 | B1 | 7/2002 | Russ, IV et al. |

(Continued)

FOREIGN PATENT DOCUMENTS

| | | |
|---|---|---|
| CA | 2281405 | 3/2000 |
| EP | 1271138 | 1/2003 |
| GB | 2315364 | 1/1998 |
| JP | 11-307040 | 11/1999 |
| JP | 2000-113852 | 4/2000 |
| JP | 2000-123780 | 4/2000 |
| WO | WO 92/14259 | 8/1992 |
| WO | WO 97/49111 | 12/1997 |
| WO | WO 02/43105 | 5/2002 |

OTHER PUBLICATIONS

Ji et al., "A Segmented Ring, Cylindrical Ion Trap Source for Time–of–Flight Mass Spectrometry", Journal of American Society for Mass Spectrometry, vol. 7, pp. 1009–1017, 1996.
Gerlich, "Rf Ion Guides", Encyclopedia of Mass Spectrometry, vol. 5 Chemistry and Physics of Gas–Phase Ions, pp. 1–34, 2003.

(Continued)

*Primary Examiner*—John R. Lee
*Assistant Examiner*—David A. Vanore
(74) *Attorney, Agent, or Firm*—Diederiks & Whitelaw, PLC

(57) ABSTRACT

An ion tunnel ion trap comprises a plurality of electrodes having apertures. The ion tunnel ion trap is preferably coupled to a time of flight mass analyser.

15 Claims, 5 Drawing Sheets

U.S. PATENT DOCUMENTS

| | | | | |
|---|---|---|---|---|
| 6,483,109 | B1 | | 11/2002 | Reinhold et al. |
| 6,504,150 | B1 | * | 1/2003 | Verentchikov et al. ..... 250/286 |
| 6,545,268 | B1 | | 4/2003 | Verentchikov et al. |
| 6,559,444 | B2 | | 5/2003 | Franzen |
| 6,593,570 | B2 | | 7/2003 | Li et al. |
| 6,617,577 | B2 | | 9/2003 | Krutchinsky et al. |
| 6,642,514 | B2 | | 11/2003 | Bateman et al. |
| 6,670,606 | B2 | | 12/2003 | Verentchikov et al. |
| 2002/0063207 | A1 | | 5/2002 | Bateman et al. |
| 2002/0063209 | A1 | | 5/2002 | Bateman et al. |
| 2002/0063210 | A1 | | 5/2002 | Bateman et al. |
| 2002/0079443 | A1 | | 6/2002 | Krutchinsky et al. |
| 2002/0113207 | A1 | | 8/2002 | Lee et al. |
| 2002/0148959 | A1 | | 10/2002 | Weiss et al. |

OTHER PUBLICATIONS

Giles et al., "Evaluation of a Stacked–Ring Radio Frequency Ion Transmission Device at Intermediate Pressures", ASMS, 2001.

Luca et al., "On the Combination of a Linear Field Free Trap With a Time–of–Flight Mass Spectrometer", Review of Scientific Instruments, vol. 72, No. 7, pp. 2900–2908, 2001.

Kim et al., "Design and Implementation of a New Electrodynamic Ion Funnel", Analytical Chemistry, vol. 72, No. 10, pp. 2247–2255, 2000.

Tolmachev et al., "Charge Capacity Limitations of Radio Frequency Ion Guides in Their Use for Improved Ion Accumulation and Trapping in Mass Spectrometry", Analytical Chemistry, vol. 72, No. 5, pp. 970–978, 2000.

Shaffer et al., "Characterization of an Improved Electrodynamic Ion Funnel Interface for Electrospray Ionization Mass Spectrometry", Analytical Chemistry, vol. 71, No. 15, pp. 2957–2964, 1999.

Shaffer et al., "An Ion Funnel Interface for Improved Ion Focusing and Sensitivity Using Electrospray Ionization Mass Spectrometry", Analytical Chemistry, vol. 70, No. 19, pp, 4111–4119, 1998.

Shaffer et al., "A Novel Ion Funnel for Focusing Ions at Elevated Pressure Using Electrospray Ionization Mass Spectrometry", Rapid Communications in Mass Spectrometry, vol. 11, pp. 1813–1817, 1997.

Shaffer et al., "A Novel Ion Funnel for Ion Focusing at Elevated Pressures", ASMS Book of Abstracts, pp. 375, 1997.

Franzen et al., "Electrical Ion Guides", ASMS Book of Abstracts, pp. 1170, 1996.

Guan et al., "Stacked–Ring Electrostatic Ion Guide", Journal American Society for Mass Spectrometry, vol. 7, pp. 101–106, 1996.

Gerlich et al., "Ion Trap Studies of Association Processes in Collisions of $CH_{3^+}$ and $CD_{3^+}$ with n–$H_2$, p–$H_2$, $D_2$, and He at 80 K", The Astrophysical Journal, vol. 347, pp. 849–854, 1989.

Teloy et al., "Integral Cross Sections for Ion–Molecule Reactions. 1. The Guided Beam Technique", Chemical Physics, pp. 417–427, 1974.

Gerlich, "Inhomogeneous RF Fields: A Versatile Tool For the Study of Processes With Slow Ions", Advances in Chemical Physics Series, vol. 82, pp. 1–176, 1992.

* cited by examiner

MASS SPECTROMETER

This application represents a continuation of U.S. patent application Ser. No. 10/178,854 filed Jun. 25, 2002, pending.

BACKGROUND OF THE INVENTION

The present invention relates to mass spectrometers.

Time of flight mass analysers are discontinuous devices in that they receive a packet of ions which is then injected into the drift region of the time of flight mass analyser by energising a pusher/puller electrode. Once injected into the drift regions, the ions become temporally separated according to their mass to charge ratio and the time taken for an ion to reach a detector can be used to give an accurate determination of the mass to charge ratio of the ion in question.

Many commonly used ion sources are continuous ion sources such as Electrospray or Atmospheric Pressure Chemical Ionisation ("APCI"). In order to couple a continuous ion source to a discontinuous time of flight mass analyser an ion trap may be used. The ion trap may continuously accumulate ions from the ion source and periodically release ions in a pulsed manner so as to ensure a high duty cycle when coupled to a time of flight mass analyser.

A commonly used ion trap is a 3D quadrupole ion trap. 3D quadrupole ion traps comprise a central doughnut shaped electrode together with two generally concave endcap electrodes with hyperbolic surfaces. 3D quadrupole ion traps are relatively small devices and the internal diameter of the central doughnut shaped electrode may be less than 1 cm with the two generally concave endcap electrodes being spaced by a similar amount. Once appropriate confining electric fields have been applied to the ion trap, then the ion containment volume (and hence the number of ions which may be trapped) is relatively small. The maximum density of ions which can be confined in a particular volume is limited by space charge effects since at high densities ions begin to electrostatically repel one another.

It is desired to provide an improved ion trap, particularly one which is suitable for use with a time of flight mass analyser.

SUMMARY OF THE INVENTION

According to a first aspect of the present invention, there is provided a mass spectrometer comprising:

an ion tunnel ion trap comprising a plurality of electrodes having apertures through which ions are transmitted in use; and a time of flight mass analyser.

In all embodiments of the present invention ions are not substantially fragmented within the ion tunnel ion trap i.e. the ion tunnel ion trap is not used as a fragmentation cell. Furthermore, an ion tunnel ion trap should not be construed as covering either a linear 2D rod set ion trap or a 3D quadrupole ion trap. An ion tunnel ion trap is different from other forms of ion optical devices such as multipole rod set ion guides because the electrodes forming the main body of the ion trap comprise ring, annular, plate or substantially closed loop electrodes. Ions therefore travel within an aperture within the electrode which is not the case with multipole rod set ion guides.

The ion tunnel ion trap is advantageous compared with a 3D quadrupole ion trap since it may have a much larger ion confinement volume. For example, the ion confinement volume of the ion tunnel ion trap may be selected from the group consisting: (i) $\geqq 20$ mm$^3$; (ii) $\geqq 50$ mm$^3$; (iii) $\geqq 100$ mm$^3$; (iv) $\geqq 200$ mm$^3$; (v) $\geqq 500$ mm$^3$; (vi) $\geqq 1000$ mm$^3$; (vii) $\geqq 1500$ mm$^3$; (viii) $\geqq 2000$ mm$^3$; (ix) $\geqq 2500$ mm$^3$; (x) $\geqq 3000$ mm$^3$; and (xi) $\geqq 3500$ mm$^3$. The increase in the volume available for ion storage may be at least a factor x2, x3, x4, x5, x6, x7, x8, x9, x10, or more than x10 compared with a conventional 3D quadrupole ion trap.

The time of flight analyser comprises a pusher and/or puller electrode for ejecting packets of ions into a substantially field free or drift region wherein ions contained in a packet of ions are temporally separated according to their mass to charge ratio. Ions are preferably arranged to be released from the ion tunnel ion trap at a predetermined time before or at substantially the same time that the pusher and/or puller electrode ejects a packet of ions into the field free or drift region.

Most if not all of the electrodes forming the ion tunnel ion trap are connected to an AC or RF voltage supply which acts to confine ions with the ion tunnel ion trap. According to less preferred embodiments, the voltage supply may not necessarily output a sinusoidal waveform, and according to some embodiments a non-sinusoidal waveform such as a square wave may be provided.

The ion tunnel ion trap is arranged to accumulate and periodically release ions without substantially fragmenting ions. According to a particularly preferred embodiment, an axial DC voltage gradient may be maintained in use along at least a portion of the length of the ion tunnel ion trap. An axial DC voltage gradient may be particularly beneficial in that it can be arranged so as to urge ions within the ion trap towards the downstream exit region of the ion trap. When the trapping potential at the exit of the ion trap is then removed, ions are urged out of the ion tunnel ion trap by the axial DC voltage gradient. This represents a significant improvement over other forms of ion traps which do not have axial DC voltage gradients.

Preferably, the axial DC voltage difference maintained along a portion of the ion tunnel ion trap is selected from the group consisting of: (i) 0.1–0.5 V; (ii) 0.5–1.0 V; (iii) 1.0–1.5 V; (iv) 1.5–2.0 V; (v) 2.0–2.5 V; (vi) 2.5–3.0 V; (vii) 3.0–3.5 V; (viii) 3.5–4.0 V; (ix) 4.0–4.5 V; (x) 4.5–5.0 V; (xi) 5.0–5.5 V; (xii) 5.5–6.0 V; (xiii) 6.0–6.5 V; (xiv) 6.5–7.0 V; (xv) 7.0–7.5 V; (xvi) 7.5–8.0 V; (xvii) 8.0–8.5 V; (xviii) 8.5–9.0 V; (xix) 9.0–9.5 V; (xx) 9.5–10.0 V; and (xxi) >10V. Preferably, an axial DC voltage gradient is maintained along at least a portion of ion tunnel ion trap selected from the group consisting of: (i) 0.01–0.05 V/cm; (ii) 0.05–0.10 V/cm; (iii) 0.10–0.15 V/cm; (iv) 0.15–0.20 V/cm; (v) 0.20–0.25 V/cm; (vi) 0.25–0.30 V/cm; (vii) 0.30–0.35 V/cm; (viii) 0.35–0.40 V/cm; (ix) 0.40–0.45 V/cm; (x) 0.45–0.50 V/cm; (xi) 0.50–0.60 V/cm; (xii) 0.60–0.70 V/cm; (xiii) 0.70–0.80 V/cm; (xiv) 0.80–0.90 V/cm; (xv) 0.90–1.0 V/cm; (xvi) 1.0–1.5 V/cm; (xvii) 1.5–2.0 V/cm; (xviii) 2.0–2.5 V/cm; (xix) 2.5–3.0 V/cm; and (xx) >3.0 V/cm.

In a preferred form, the ion tunnel ion trap comprises a plurality of segments, each segment comprising a plurality of electrodes having apertures through which ions are transmitted and wherein all the electrodes in a segment are maintained at substantially the same DC potential and wherein adjacent electrodes in a segment are supplied with different phases of an AC or RF voltage. A segmented design simplifies the electronics associated with the ion tunnel ion trap.

The ion tunnel ion trap preferably consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; (xv) >150 electrodes; (xvi) ≧5 electrodes; and (xvii) ≧10 electrodes.

The diameter of the apertures of at least 50% of the electrodes forming the ion tunnel ion trap is preferably selected from the group consisting of: (i) ≦10 mm; (ii) ≦9 mm; (iii) ≦8 mm; (iv) ≦7 mm; (v) ≦6 mm; (vi) ≦5 mm; (vii) ≦4 mm; (viii) ≦3 mm; (ix) ≦2 mm; and (x) ≦1 mm. At least 50%, 60%, 70%, 80%, 90% or 95% of the electrodes forming the ion tunnel ion trap may have apertures which are substantially the same size or area in contrast to an ion funnel arrangement. The thickness of at least 50% of the electrodes forming the ion tunnel ion trap may be selected from the group consisting of: (i) ≦3 mm; (ii) ≦2.5 mm; (iii) ≦2.0 mm; (iv) ≦1.5 mm; (v) ≦1.0 mm; and (vi) ≦0.5 mm. Preferably, at least 10%, 20%, 30%, 40%, 50%, 60%, 70%, 80%, 90%, or 95% of the electrodes are connected to both a DC and an AC or RF voltage supply. Preferably, the ion tunnel ion trap has a length selected from the group consisting of: (i) <5 cm; (ii) 5–10 cm; (iii) 10–15 cm; (iv) 15–20 cm; (v) 20–25 cm; (vi) 25–30 cm; and (vii) >30 cm.

Preferably, means is provided for introducing a gas into the ion tunnel ion trap for collisional cooling without fragmentation of ions. Ions emerging from the ion tunnel ion trap will therefore have a narrower spread of energies which is beneficial when coupling the ion trap to a time of flight mass analyser. The ions may be arranged to enter the ion tunnel ion trap with a majority of the ions having an energy ≦5 eV for a singly charged ion so as to cause collisional cooling of the ions. The ion tunnel ion trap may be maintained, in use, at a pressure selected from the group consisting of: (i) $>1.0\times10^{-3}$ mbar; (ii) $>5.0\times10^{-3}$ mbar; (iii) $>1.0\times10^{-2}$ mbar; (iv) $10^{-3}$–$10^{-2}$ mbar; and (v) $10^{-4}$–$10^{-1}$ mbar.

Although the ion tunnel ion trap is envisaged to be used primarily with a continuous ion source other embodiments of the present invention are contemplated wherein a pulsed ion source may nonetheless be used. The ion source may comprise an Electrospray ("ESI"), Atmospheric Pressure Chemical Ionisation ("APCI"), Atmospheric Pressure Photo Ionisation ("APPI"), Matrix Assisted Laser Desorption Ionisation ("MALDI"), Laser Desorption Ionisation ion source, Inductively Coupled Plasma ("ICP"), Electron Impact ("EI") or Chemical Ionisation ("CI") ion source.

Preferred ion sources such as Electrospray or APCI ion sources are continuous ion sources whereas a time of flight analyser is a discontinuous device in that it requires a packet of ions. The ions are then injected with substantially the same energy into a drift region. Ions become temporally separated in the drift region accordingly to their differing masses, and the transit time of the ion through the drift region is measured giving an indication of the mass of the ion. The ion tunnel ion trap according to the preferred embodiment is effective in essentially coupling a continuous ion source with a discontinuous mass analyser such as a time of flight mass analyser.

Preferably, the ion tunnel ion trap comprises an entrance and/or exit electrode for trapping ions within the ion tunnel ion trap.

According to a second aspect of the present invention, there is provided amass spectrometer comprising:

an ion tunnel ion trap comprising ≧10 ring or plate electrodes having substantially similar internal apertures between 2–10 mm in diameter and wherein a DC potential gradient is maintained, in use, along a portion of the ion tunnel ion trap and two or more axial potential wells are formed along the length of the ion trap.

The DC potential gradient can urge ions out of the ion trap once a trapping potential has been removed.

According to a third aspect of the present invention, there is provided:

an ion tunnel ion trap comprising at least three segments, each segment comprising at least four electrodes having substantially similar sized apertures through which ions are transmitted in use;

wherein in a mode of operation:

electrodes in a first segment are maintained at substantially the same first DC potential but adjacent electrodes are supplied with different phases of an AC or RF voltage supply;

electrodes in a second segment are maintained at substantially the same second DC potential but adjacent electrodes are supplied with different phases of an AC or RF voltage supply;

electrodes in a third segment are maintained at substantially the same third DC potential but adjacent electrodes are supplied with different phases of an AC or RF voltage supply;

wherein the first, second and third DC potentials are all different.

The ability to be able to individually control multiple segments of an ion trap affords significant versatility which is not an option with conventional ion traps. For example, multiple discrete trapping regions can be provided.

According to a fourth aspect of the present invention, there is provided a mass spectrometer comprising:

an ion tunnel ion trap comprising a plurality of electrodes having apertures through which ions are transmitted in use, wherein the transit time of ions through the ion tunnel ion trap is selected from the group comprising: (i) ≦0.5 ms; (ii) ≦1.0 ms; (iii) ≦5 ms; (iv) ≦10 ms; (v) ≦20 ms; (vi) 0.01–0.5 ms; (vii) 0.5–1 ms; (viii) 1–5 ms; (ix) 5–10 ms; and (x) 10–20 ms.

By providing an axial DC potential ions can be urged through the ion trap much faster than conventional ion traps.

According to a fifth aspect of the present invention, there is provided a mass spectrometer comprising:

an ion tunnel ion trap, the ion tunnel ion trap comprising a plurality of electrodes having apertures through which ions are transmitted in use, and wherein in a mode of operation trapping DC voltages are supplied to some of the electrodes so that ions are confined in two or more axial DC potential wells.

The ability to provide two or more trapping regions in a single ion trap is particularly advantageous.

According to a sixth aspect of the present invention, there is provided a mass spectrometer comprising:

an ion tunnel ion trap comprising a plurality of electrodes having apertures through which ions are transmitted in use, and wherein in a mode of operation a V-shaped, W-shaped, U-shaped, sinusoidal, curved, stepped or linear axial DC potential profile is maintained along at least a portion of the ion tunnel ion trap.

Since preferably the DC potential applied to individual electrodes or groups of electrodes can be individually controlled, numerous different desired axial DC potential profiles can be generated.

According to a seventh aspect of the present invention, there is provided a mass spectrometer comprising:

an ion tunnel ion trap comprising a plurality of electrodes having apertures through which ions are transmitted in use, and wherein in a mode of operation an upstream portion of the ion tunnel ion trap continues to receive ions into the ion tunnel ion trap whilst a downstream portion of the ion tunnel ion trap separated from the upstream portion by a potential barrier stores and periodically releases ions. According to this arrangement, no ions are lost as the ion trap substantially stores all the ions it receives.

Preferably, the upstream portion of the ion tunnel ion trap has a length which is at least 10%, 20%, 30%, 40%, 50%, 60%, 70%, 80%, or 90% of the total length of the ion tunnel ion trap. Preferably, the downstream portion of the ion tunnel ion trap has a length which is less than or equal to 10%, 20%, 30%, 40%, 50%, 60%, 70%, 80%, or 90% of the total length of the ion tunnel ion trap. Preferably, the downstream portion of the ion tunnel ion trap is shorter than the upstream portion of the ion tunnel ion trap.

According to an eighth aspect of the present invention, there is provided a mass spectrometer comprising:

a continuous ion source for emitting a beam of ions;

an ion trap arranged downstream of the ion source, the ion trap comprising ≧5 electrodes having apertures through which ions are transmitted in use, wherein the electrodes are arranged to radially confine ions within the apertures, and wherein ions are accumulated and periodically released from the ion trap without substantial fragmentation of the ions; and a discontinuous mass analyser arranged to receive ions released from the ion trap.

Preferably, an axial DC voltage gradient is maintained along at least 5%, 10%, 15%, 20%, 25%, 30%, 35%, 40%, 45%, 50%, 55%, 60%, 65%, 70%, 75%, 80%, 85%, 90% or 95% of the length of the ion trap.

Preferably, the continuous ion source comprises an Electrospray or Atmospheric Pressure Chemical Ionisation ion source.

Preferably, the discontinuous mass analyser comprises a time of flight mass analyser.

According to a ninth aspect of the present invention, there is provided a method of mass spectrometry, comprising:

trapping ions in an ion tunnel ion trap comprising a plurality of electrodes having apertures through which ions are transmitted in use; and releasing ions from the ion tunnel ion trap to a time of flight mass analyser.

Preferably, an axial DC voltage gradient is maintained along at least a portion of the length of the ion trap.

BRIEF DESCRIPTION OF THE DRAWINGS

Various embodiments of the present invention will now be described, by way of example only, and with reference to the accompanying drawings in which:

FIG. 3(*b*) shows a side view of an upper ion tunnel section;

FIG. 3(*c*) shows a plan view of an ion tunnel segment;

FIG. 7(*b*) shows a corresponding "closed" mode of operation; and

FIG. 7(*c*) shows a corresponding "empty" mode of operation.

DETAILED DESCRIPTION OF THE PREFERRED EMBODIMENTS

Figure 1:
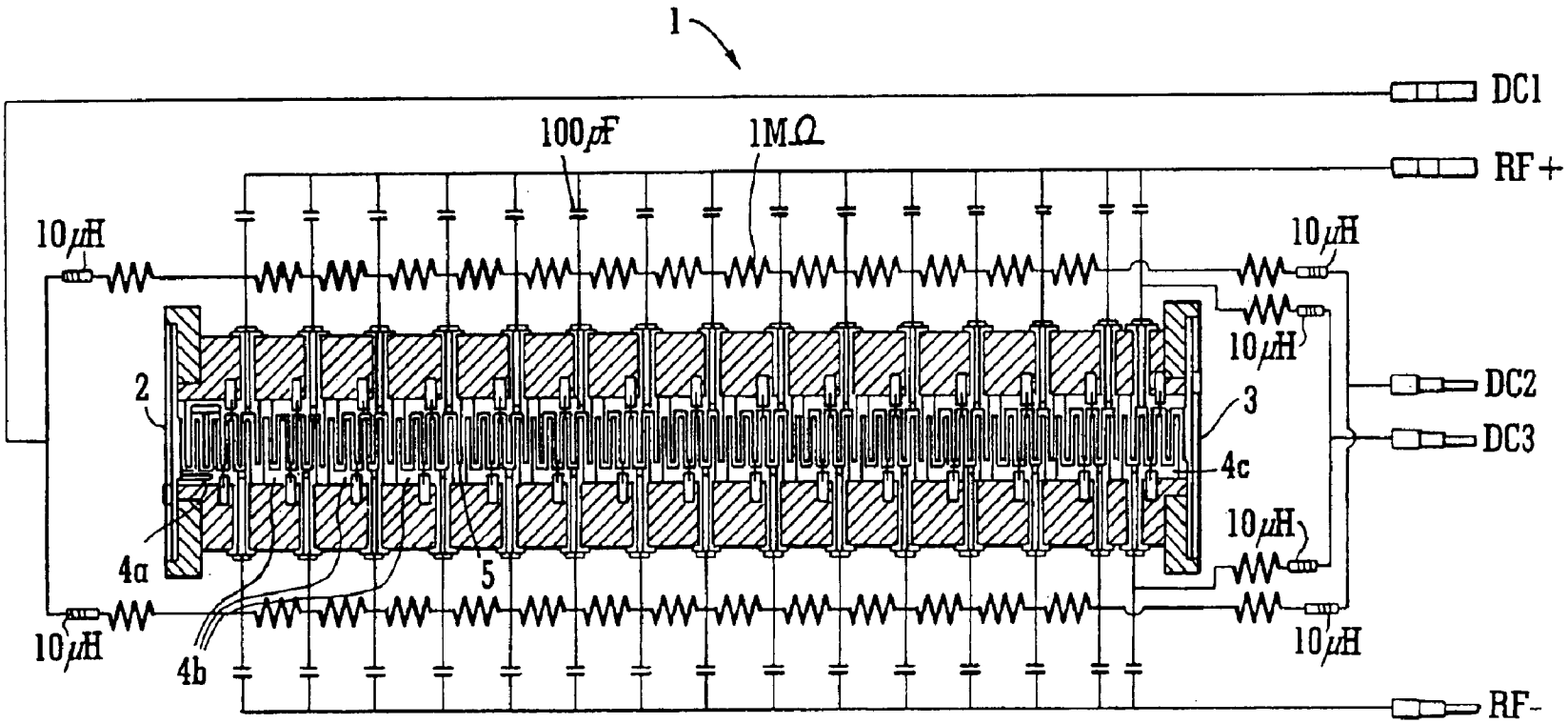
FIG. 1 shows a preferred ion tunnel ion trap.

A preferred ion tunnel ion trap will now be described in relation to FIGS. 1 and 2. The ion tunnel ion trap 1 comprises a housing having an entrance aperture 2 and an exit aperture 3. The entrance and exit apertures 2,3 are preferably substantially circular apertures. The plates forming the entrance and/or exit apertures 2,3 may be connected to independent programmable DC voltage supplies (not shown).

Between the plate forming the entrance aperture 2 and the plate forming the exit aperture 3 are arranged a number of electrically isolated ion tunnel segments 4*a*, 4*b*, 4*c*. In one embodiment fifteen segments 4*a*, 4*b*, 4*c* are provided. Each ion tunnel segment 4*a*; 4*b*; 4*c* comprises two interleaved and electrically isolated sections i.e. an upper and lower section. The ion tunnel segment 4*a* closest to the entrance aperture 2 preferably comprises ten electrodes (with five electrodes in each section) and the remaining ion tunnel segments 4*b*, 4*c* preferably each comprise eight electrodes (with four electrodes in each section). All the electrodes are preferably substantially similar in that they have a central substantially circular aperture (preferably 5 mm in diameter) through which ions are transmitted. The entrance and exit apertures 2,3 may be smaller e.g. 2.2 mm in diameter than the apertures in the electrodes or the same size.

All the ion tunnel segments 4*a*, 4*b*, 4*c* are preferably connected to the same AC or RF voltage supply, but different segments 4*a*; 4*b*; 4*c* may be provided with different DC voltages. The two sections forming an ion tunnel segment 4*a*; 4*b*; 4*c* are connected to different, preferably opposite, phases of the AC or RF voltage supply.

Figure 3:
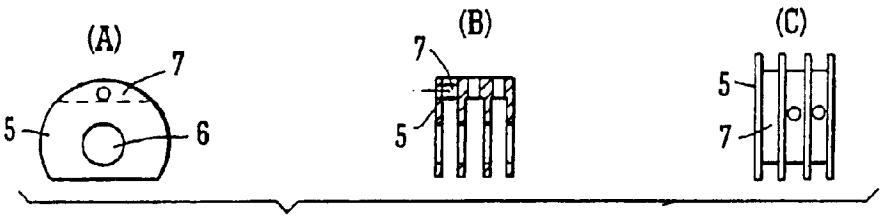
FIG. 3(*a*) shows a front view of an ion tunnel segment.

A single ion tunnel section is shown in greater detail in FIGS. 3(*a*)–(*c*). The ion tunnel section has four (or five) electrodes 5, each electrode 5 having a 5 mm diameter central aperture 6. The four (or five) electrodes 5 depend or extend from a common bar or spine 7 and are preferably truncated at the opposite end to the bar 7 as shown in FIG. 3(*a*). Each electrode 5 is typically 0.5 mm thick. Two ion tunnel sections are interlocked or interleaved to provide a total of eight (or ten) electrodes 5 in an ion tunnel segment 4*a*; 4*b*; 4*c* with a 1 mm inter-electrode spacing once the two sections have been interleaved. All the eight (or ten) electrodes 5 in an ion tunnel segment 4*a*; 4*b*; 4*c* comprised of two separate sections are preferably maintained at substantially the same DC voltage. Adjacent electrodes in an ion tunnel segment 4*a*; 4*b*; 4*c* comprised of two interleaved sections are connected to different, preferably opposite, phases of an AC or RF voltage supply i.e. one section of an ion tunnel segment 4*a*; 4*b*; 4*c* is connected to one phase (RF+) and the other section of the ion tunnel segment 4*a*; 4*b*; 4*c* is connected to another phase (RF−).

Each ion tunnel segment 4*a*; 4*b*; 4*c* is mounted on a machined PEEK support that acts as the support for the entire assembly. Individual ion tunnel sections are located and fixed to the PEEK support by means of a dowel and a screw. The screw is also used to provide the electrical connection to the ion tunnel section. The PEEK supports are held in the correct orientation by two stainless steel plates attached to the PEEK supports using screws and located correctly using dowels. These plates are electrically isolated and have a voltage applied to them.

Gas for collisionally cooling ions without substantially fragmenting ions may be supplied to the ion tunnel ion trap 1 via a 4.5 mm ID tube.

Figure 2:
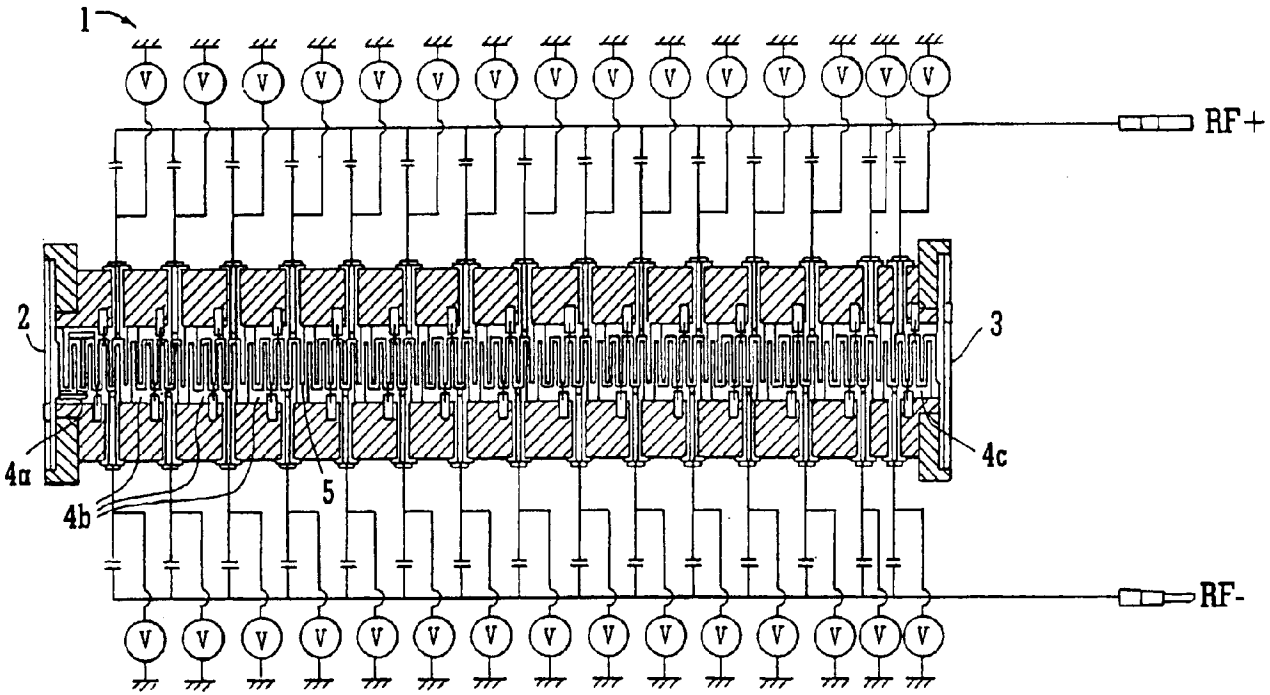
FIG. 2 shows another ion tunnel ion trap wherein the DC voltage supply to each ion tunnel segment is individually controllable.
Figure 4:
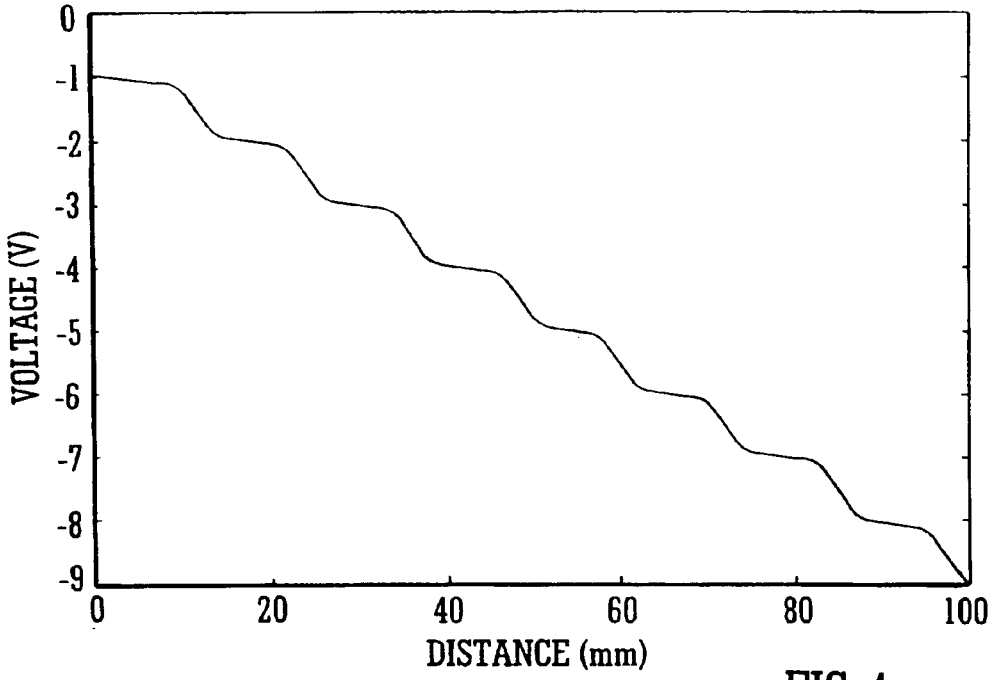
FIG. 4 shows an axial DC potential profile as a function of distance at a central portion of an ion tunnel ion trap.
Figure 5:
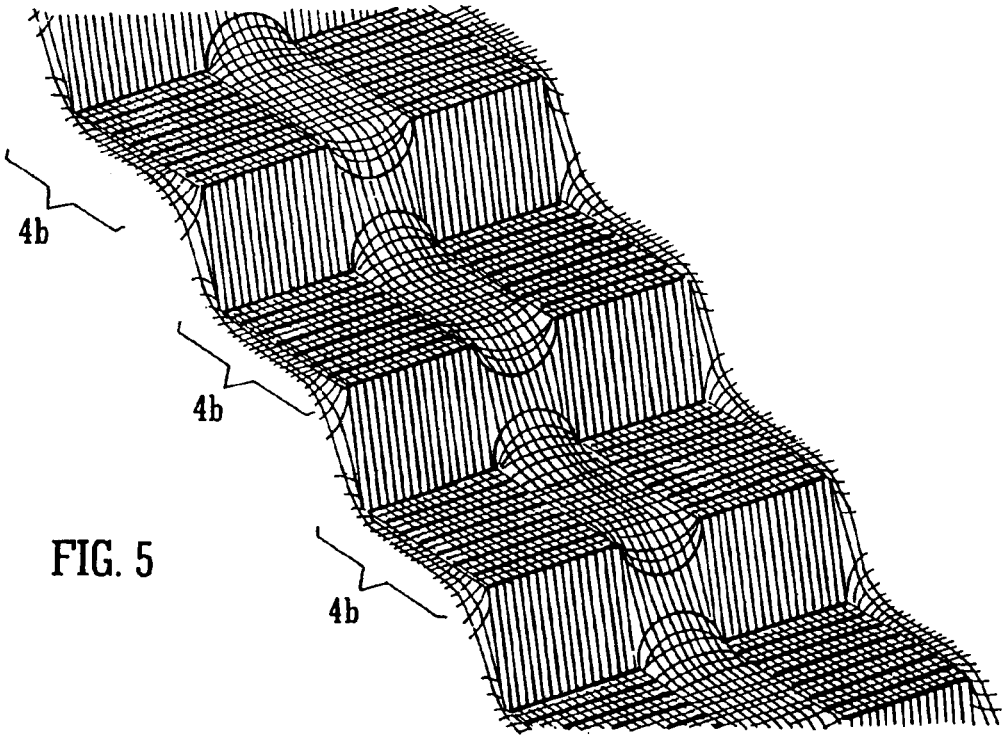
FIG. 5 shows a potential energy surface across a number of ion tunnel segments at a central portion of an ion tunnel ion trap.

The electrical connections shown in FIG. 1 are such that a substantially regular stepped axial accelerating DC electric field is provided along the length of the ion tunnel ion trap 1 using two programmable DC power supplies DC1 and DC2 and a resistor potential divider network of 1 MΩ resistors. An AC or RF voltage supply provides phase (RF+) and anti-phase (RF−) voltages at a frequency of preferably 1.75 MHz and is coupled to the ion tunnel sections 4*a*, 4*b*, 4*c* via capacitors which are preferably identical in value (100 pF). According to other embodiments the frequency may be in the range of 0.1–3.0 MHz. Four 10 μH inductors are provided in the DC supply rails to reduce any RF feedback onto the DC supplies. A regular stepped axial DC voltage gradient is provided if all the resistors are of the same value. Similarly, the same AC or RF voltage is supplied to all the electrodes if all the capacitors are the same value. FIG. 4 shows how, in one embodiment, the axial DC potential varies across a 10 cm central portion of the ion tunnel ion trap 1. The inter-segment voltage step in this particular embodiment is −1V. However, according to more preferred embodiments lower voltage steps of e.g. approximately −0.2V may be used. FIG. 5 shows a potential energy surface across several ion tunnel segments 4*b* at a central portion of the ion tunnel ion trap 1. As can be seen, the potential energy profile is such that ions will cascade from one ion tunnel segment to the next.

As will now be described in relation to FIG. 1, the ion tunnel ion trap 1 traps, accumulates or otherwise confines ions within the ion tunnel ion trap 1. In the embodiment shown in FIG. 1, the DC voltage applied to the final ion tunnel segment 4*c* (i.e. that closest and adjacent to the exit aperture 3) is independently controllable and can in one mode of operation be maintained at a relatively high DC blocking or trapping potential (DC3) which is more positive for positively charged ions (and vice versa for negatively charged ions) than the preceding ion tunnel segment(s) 4*b*. Other embodiments are also contemplated wherein other ion tunnel segments 4*a*, 4*b* may alternatively and/or additionally be maintained at a relatively high trapping potential. When the final ion tunnel segment 4*c* is being used to trap ions within the ion tunnel ion trap 1, an AC or RF voltage may or may not be applied to the final ion tunnel segment 4*c*.

The DC voltage supplied to the plates forming the entrance and exit apertures 2,3 is also preferably independently controllable and preferably no AC or RF voltage is supplied to these plates. Embodiments are also contemplated wherein a relatively high DC trapping potential may be applied to the plates forming entrance and/or exit aperture 2,3 in addition to or instead of a trapping potential being supplied to one or more ion tunnel segments such as at least the final ion tunnel segment 4*c*.

In order to release ions from confinement within the ion tunnel ion trap 1, the DC trapping potential applied to e.g. the final ion tunnel segment 4*c* or to the plate forming the exit aperture 3 is preferably momentarily dropped or varied, preferably in a pulsed manner. In one embodiment the DC voltage may be dropped to approximately the same DC voltage as is being applied to neighbouring ion tunnel segment(s) 4*b*. Embodiments are also contemplated wherein the voltage may be dropped below that of neighbouring ion tunnel segment(s) so as to help accelerate ions out of the ion tunnel ion trap 1. In another embodiment a V-shaped trapping potential may be applied which is then changed to a linear profile having a negative gradient in order to cause ions to be accelerated out of the ion tunnel ion trap 1. The voltage on the plate forming the exit aperture 3 can also be set to a DC potential such as to cause ions to be accelerated out of the ion tunnel ion trap 1.

Figure 6:
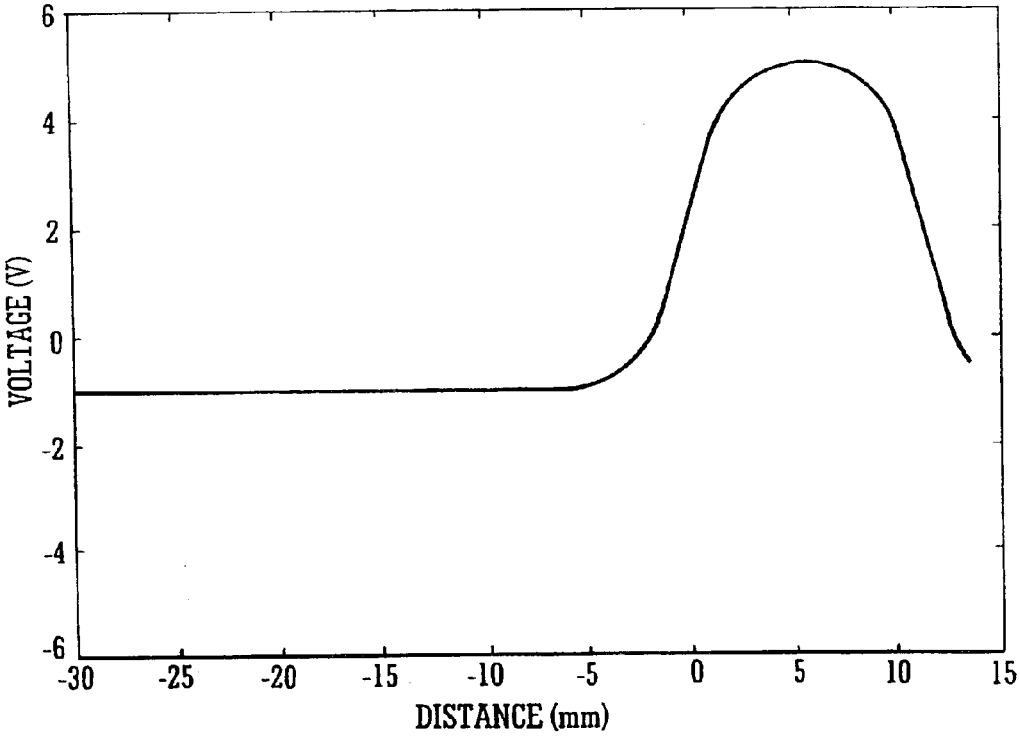
FIG. 6 shows a portion of an axial DC potential profile for an ion tunnel ion trap being operated in an trapping mode without an accelerating axial DC potential gradient being applied along the length of the ion tunnel ion trap.

Other less preferred embodiments are contemplated wherein no axial DC voltage difference or gradient is applied or maintained along the length of the ion tunnel ion trap 1. FIG. 6, for example, shows how the DC potential may vary along a portion of the length of the ion tunnel ion trap 1 when no axial DC field is applied and the ion tunnel ion trap 1 is acting in a trapping or accumulation mode. In this figure, 0 mm corresponds to the midpoint of the gap between the fourteenth 4*b* and fifteenth (and final) 4*c* ion tunnel segments. In this particular example, the blocking potential was set to +5V (for positive ions) and was applied to the last (fifteenth) ion tunnel segment 4*c* only. The preceding fourteen ion tunnel segments 4*a*, 4*b* had a potential of −1V applied thereto. The plate forming the entrance aperture 2 was maintained at 0V DC and the plate forming the exit aperture 3 was maintained at −1V.

Figure 7:
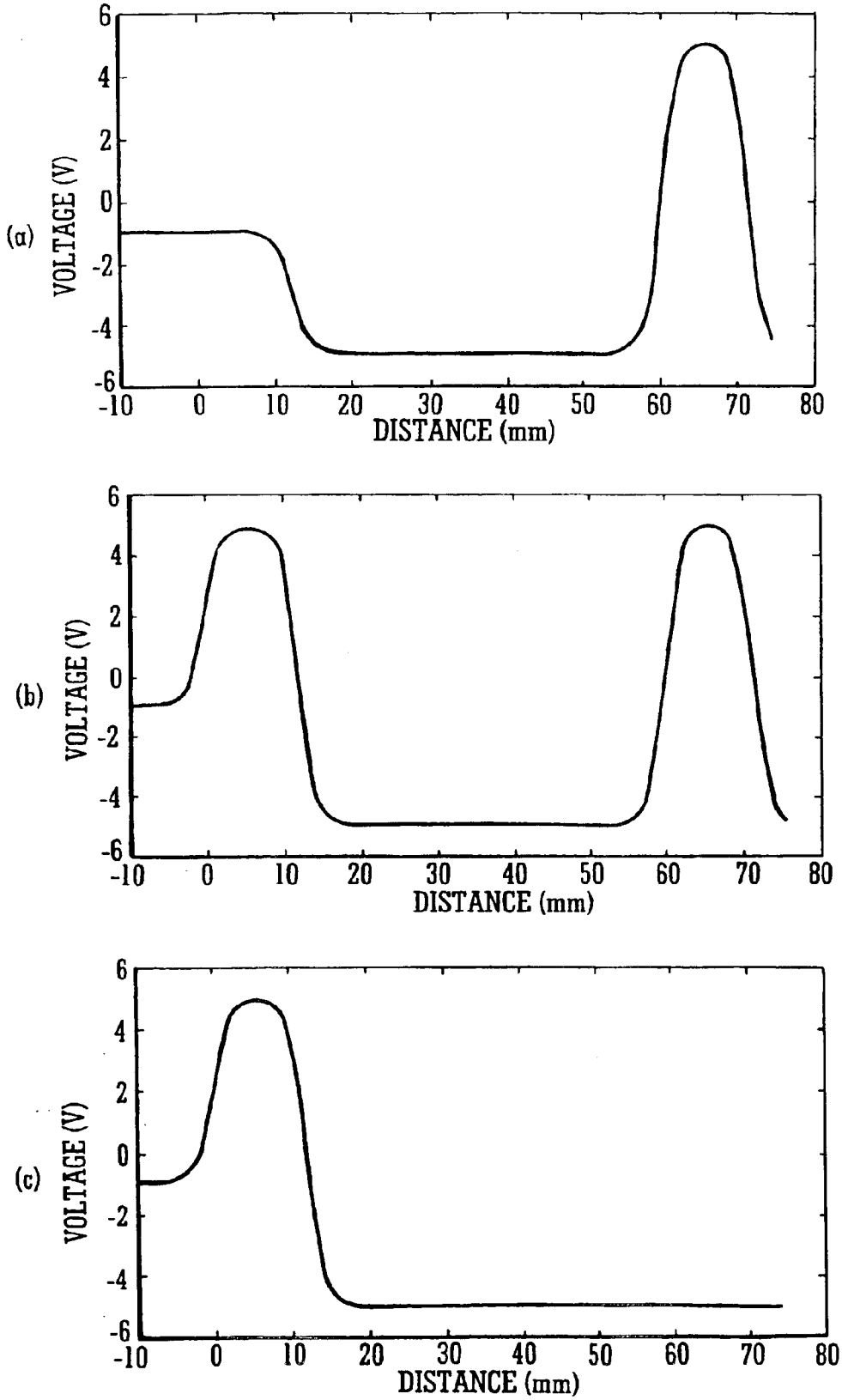
FIG. 7(*a*) shows an axial DC potential profile for an ion tunnel ion trap operated in a "fill" mode of operation.

More complex modes of operation are contemplated wherein two or more trapping potentials may be used to isolate one or more section(s) of the ion tunnel ion trap 1. For example, FIG. 7(*a*) shows a portion of the axial DC potential profile for an ion tunnel ion trap 1 according to one embodiment operated in a "fill" mode of operation, FIG. 7(*b*) shows a corresponding "closed" mode of operation, and FIG. 7(*c*) shows a corresponding "empty" mode of operation. By sequencing the potentials, the ion tunnel ion trap 1 may be opened, closed and then emptied in a short defined pulse. In the example shown in the figures, 0 mm corresponds to the midpoint of the gap between the tenth and eleventh ion tunnel segments 4*b*. The first nine segments 4*a*, 4*b* are held at −1V, the tenth and fifteenth segments 4*b* act as potential barriers and ions are trapped within the eleventh, twelfth, thirteenth and fourteenth segments 4*b*. The trap segments are held at a higher DC potential (+5V) than the other segments 4*b*. When closed the potential barriers are held at +5V and when open they are held at −1V or −5V. This arrangement allows ions to be continuously accumulated and stored, even during the period when some ions are being released for subsequent mass analysis, since ions are free to continually enter the first nine segments 4*a*, 4*b*. A relatively long upstream length of the ion tunnel ion trap 1 may be used for trapping and storing ions and a relatively short downstream length may be used to hold and then release ions. By using a relatively short downstream length, the pulse width of the packet of ions released from the ion tunnel ion trap 1 may be constrained. In other embodiments multiple isolated storage regions may be provided.

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

an ion tunnel ion trap comprising ≧10 ring or plate electrodes having substantially similar internal apertures between 2–10 mm in diameter and wherein a DC potential gradient is maintained, in use, along a portion of the ion tunnel ion trap and two or more axial potential wells are formed along the length of the ion tunnel ion trap; and means for introducing a gas into said ion tunnel ion trap for collisional cooling without fragmentation of ions.

2. A mass spectrometer comprising:

an ion tunnel ion trap comprising at least three segments, each segment comprising at least four electrodes having substantially similar sized apertures through which ions are transmitted in use; and means for introducing a gas into said ion tunnel ion trap for collisional cooling without fragmentation of ions;

wherein in a mode of operation:

electrodes in a first segment are maintained at substantially the same first DC potential but adjacent electrodes are supplied with different phases of an AC or RF voltage supply;

electrodes in a second segment are maintained at substantially the same second DC potential but adjacent electrodes are supplied with different phases of an AC or RF voltage supply;

electrodes in a third segment are maintained at substantially the same third DC potential but adjacent electrodes are supplied with different phases of an AC or RF voltage supply;

wherein said first, second and third DC potentials are all different.

3. A mass spectrometer comprising:

an ion tunnel ion trap, said ion tunnel ion trap comprising a plurality of electrodes having apertures through which ions are transmitted in use, and wherein in a mode of operation trapping DC voltages are supplied to some of said electrodes so that ions are confined in two or more axial DC potential wells; and means for introducing a gas into said ion tunnel ion trap for collisional cooling without fragmentation of ions.

4. A mass spectrometer comprising:

an ion tunnel ion trap comprising a plurality of electrodes having apertures through which ions are transmitted in use, and wherein in a mode of operation a V-shaped, W-shaped, U-shaped, sinusoidal, curved, stepped or linear axial DC potential profile is maintained along at least a portion of said ion tunnel ion trap; and means for introducing a gas into said ion tunnel ion trap for collisional cooling without fragmentation of ions.

5. A mass spectrometer comprising:

an ion tunnel ion trap comprising a plurality of electrodes having apertures through which ions are transmitted in use, and wherein in a mode of operation an upstream portion of the ion tunnel ion trap continues to receive ions into the ion tunnel ion trap whilst a downstream portion of the ion tunnel ion trap separated from the upstream portion by a potential barrier stores and periodically releases ions; and means for introducing a gas into said ion tunnel ion tray for collisional cooling without fragmentation of ions.

6. A mass spectrometer as claimed in claim 5, wherein said upstream portion of the ion tunnel ion trap has a length which is at least 10%, 20%, 30%, 40%, 50%, 60%, 70%, 80%, or 90% of the total length of the ion tunnel ion trap.

7. A mass spectrometer as claimed in claim 5, wherein said downstream portion of the ion tunnel ion trap has a length which is less than or equal to 10%, 20%, 30%, 40%, 50%, 60%, 70%, 80%, or 90% of the total length of the ion tunnel ion trap.

8. A mass spectrometer as claimed in claim 5, wherein the downstream portion of the ion tunnel ion trap is shorter than the upstream portion of the ion tunnel ion trap.

9. A mass spectrometer as claimed in claim 5, wherein ions are substantially not fragmented within said ion tunnel ion trap.

10. A mess spectrometer as claimed in claim 1, wherein said ion tunnel ion trap accumulates and periodically releases ions without substantially fragmenting the ions.

11. A mass spectrometer as claimed in claim 1, wherein said ion tunnel ion trap comprises a plurality of segments, each segment comprising a plurality of the electrodes having the internal apertures through which ions are transmitted and wherein all the electrodes in a segment are maintained at substantially the same DC potential and wherein adjacent electrodes in a segment are supplied with different phases of an AC or RF voltage.

12. A mass spectrometer as claimed in claim 3, wherein said ion tunnel ion trap accumulates and periodically releases ions without substantially fragmenting the ions.

13. A mass spectrometer as claimed in claim 3, wherein said ion tunnel ion trap comprises a plurality of segments, each segment comprising a plurality of the electrodes having the apertures through which the ions are transmitted and wherein all the electrodes in a segment are maintained at substantially the same DC potential and wherein adjacent electrodes in a segment are supplied with different phases of an AC or RF voltage.

14. A mass spectrometer as claimed in claim 4, wherein said ion tunnel ion trap accumulates and periodically releases ions without substantially fragmenting the ions.

15. A mass spectrometer as claimed in claim 4, wherein said ion tunnel ion trap comprises a plurality of segments, each segment comprising a plurality of the electrodes having the apertures through which the ions are transmitted and wherein all the electrodes in a segment are maintained at substantially the same DC potential and wherein adjacent electrodes in a segment are supplied with different phases of an AC or RF voltage.

* * * * *